United States Patent [19]

Zimmer

[11] 3,974,766

[45]* Aug. 17, 1976

[54] PROCESS FOR IMPRINTING SPACED-APART WEB SECTIONS WITH A COMPOSITE PATTERN

[76] Inventor: Peter Zimmer, untere Sparchen 54, A 6330 Kufstein, Austria

[ * ] Notice: The portion of the term of this patent subsequent to Sept. 10, 1991, has been disclaimed.

[22] Filed: July 1, 1974

[21] Appl. No.: 485,001

Related U.S. Application Data

[62] Division of Ser. No. 395,554, Sept. 10, 1973.

[52] U.S. Cl. ..... 101/129; 101/115; 101/247; 101/248; 101/426

[51] Int. Cl.[2] ..... B41F 15/10

[58] Field of Search ..... 101/129, 116, 115, 181, 101/248, 182, 426, 183, 170, 184

[56] References Cited

UNITED STATES PATENTS

| | | | |
|---|---|---|---|
| 3,068,787 | 12/1962 | Dall'Ogio et al. | 101/181 |
| 3,152,542 | 10/1964 | Chambon | 101/181 |
| 3,559,568 | 2/1971 | Stanley | 101/181 X |
| 3,774,533 | 11/1973 | Ichinase | 101/119 |
| 3,834,309 | 9/1974 | Zimmer | 101/115 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A machine for printing a recurrent pattern on sections of predetermined length of a textile web, comprising a number of parallel rotary-screen printing units spaced apart in the direction of web motion, includes a first sensor for detecting the leading edge of an oncoming web section to be imprinted and a second sensor for ascertaining the passage of a mark indicating the start of a printing pattern on the first unit. The odd-numbered units print the first half of the pattern, in different colors, whereas the even-numbered units print the second half in corresponding colors; between printing operations, the screen of each unit is lifted off the web and can be angularly readjusted to compensate for relative disalignment between the web sections and the printing patterns. Such disalignment is determined by the two sensors whose output signals are translated into command signals sequentially delivered to control inputs of the several odd-numbered units at equal intervals for making the necessary adjustments just before the arrival of the leading edge of a web section at these units; the control inputs of the even-numbered units receive these commands at instants delayed with reference to the midpoints of these intervals so that their adjustments take place after that leading edge has passed them. Where the sections to be imprinted are tufted fabric piles, the first sensor comprises two juxtaposed feelers, one loaded by a hard spring and the other loaded by a soft spring; an oncoming pile edge elevates the latter but not the former to cause completion of a signal circuit discriminating against seams in the web which would cause both feelers to be elevated concurrently.

8 Claims, 11 Drawing Figures

PROCESS FOR IMPRINTING SPACED-APART WEB SECTIONS WITH A COMPOSITE PATTERN

This is a division of application Ser. No. 395,554, filed Sept. 10, 1973.

FIELD OF THE INVENTION

My present invention relates to a process for printing a recurrent composite pattern on equispaced sections of a textile web, of uniform length, separated by zones not to be imprinted, by passing the web underneath a plurality of parallel printing units of the rotary-screen type spaced apart in the direction of web motion rotating in unison at a speed commensurate with the web speed, each unit including a cylindrically curved screen centered on its axis of rotation with an arc length equal to the length of a section for the printing of a respective pattern component. Such sections may consist of areas of tufted-pile fabric designed for example to form towels on being cut apart.

BACKGROUND OF THE INVENTION

Such rotary-screen units can be used to imprint a given web section successively with different color components of the recurrent pattern. If the length of a section exceeds the circumference of the screens, several screens of consecutive units may be grouped together to print different parts of the pattern in the same color. Thus, each group may consist of a first-stage unit and a second-stage unit respectively printing the front half and the rear half of the pattern; in this case the first-stage units are the odd-numbered ones and the second-stage units are the even-numbered ones as counted from the upstream end of the array.

Because of unavoidable deviations of the actual length and spacing of successive web sections from the specified dimensions, cumulative errors would result if the angular positions of the screens were not adjusted from time to time in the course of a printing run. To compensate for such errors, it has already been proposed (see U.S. Pat. No. 3,152,542) to provide automatic means for individually adjusting each printing screen in response to output signals from a pair of associated sensors, one of them being located near the screen itself while the other lies upstream of the screen adjacent the web path and is spaced from the point of contact between the screen and the web, i.e. from the nadir of the screen, by a certain distance determined by the length of the pattern. If the screen and the web are properly correlated, the two sensors simultaneously detect respective marks on the screen and the web.

OBJECTS OF THE INVENTION

The general object of my invention is to provide an efficient process for imprinting such spaced-apart web sections with proper compensation of positional errors.

A more particular object is to provide, in a process of this character particularly designed for the imprinting of tufted areas separated by untufted zones, a reliable method of distinguishing between the leading edge of a tufted area and a transverse seam in the web.

SUMMARY OF THE INVENTION

In accordance with my present invention,, the arrival of a leading edge of any web section to be imprinted is detected at a fixed point upstream of the first printing unit, as is the passage of a predetermined point on the periphery of this first printing unit. In accordance with the relative time position of the two events thus detected, i.e. whether the first precedes the second or vice versa, all printing units are angularly adjusted with no further sensing as far as this particular web section is concerned.

Pursuant to a more particular feature of my invention, the angular adjustment of the printing units is carried out sequentially with a delay corresponding to the travel time of a section from one printing unit to the next, advantageously in an elevated position thereof as each unit is lifted off the web after a printing operation. For this purpose, I prefer to store a measure of the required angular adjustment in a memory decoupled from the first printing unit preparatorily to adjustment of each subsequent unit whereby the first printing unit can be readjusted, upon the approach of each new web section, without affecting the adjustment of the other units still working on the preceding sections. Such a memory may operate either mechanically or electromagnetically, as more fully described hereinafter.

In order to discriminate between tufted areas and seams, another feature of my invention provides for a mechanical sensing of the tufts of an oncoming section with the aid of a first and a second pointed implement disposed alongside each other; these implements are loaded with a higher and a lower pressure, respectively, whereby elevation of the more lightly loaded second implement to the exclusion of the more heavily loaded first implement indicates the arrival of a leading edge of a tufted area. If a seam were present instead, both implements would be lifted simultaneously.

BRIEF DESCRIPTION OF THE DRAWING

The above and other features of my invention will now be described in detail with reference to the accompanying drawing in which.

SPECIFIC DESCRIPTION

Figure 1:
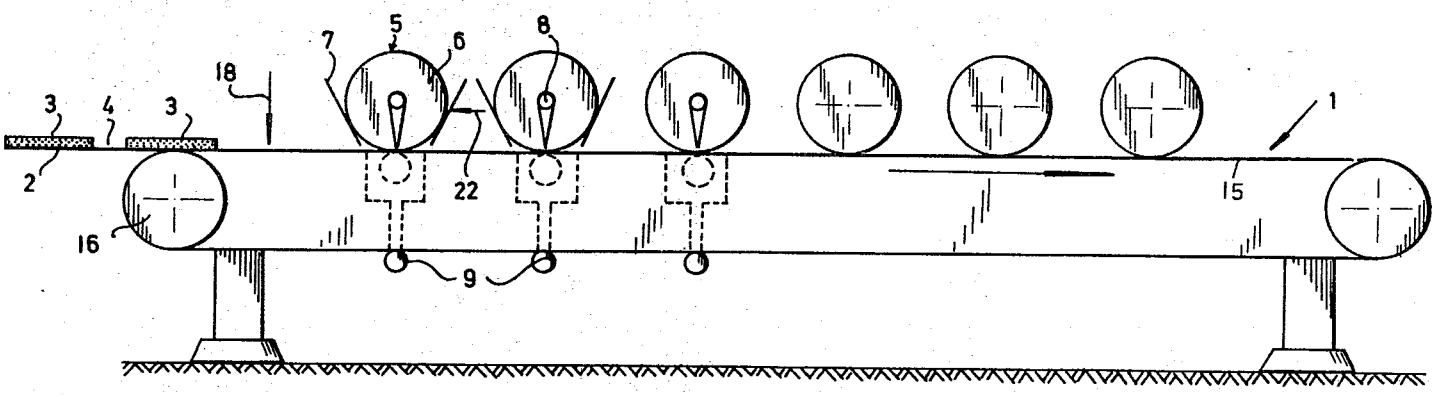
FIG. 1 is a side-elevational view of an array of printing units forming part of a machine of the character described.

In FIG. 1 I have shown a printing machine 1 with a transport belt 15 supporting a web of cloth 2 having tufted sections 3 and intermediate sections 4 of nontufted textile material. Above the machine there are located conventional printing units 5 each comprising a cylindrical screen or stencil 6 and associated tensioning frames 7. The frames 7 hold the screens 6 firmly in position and also impart longitudinal tension to them. Upon the raising of the frame assembly 7, the screens 6 are also lifted from their illustrated working position and brought out of engagement with the web of cloth to be printed. Within the screens there are located the usual ink applicators 8 which are lifted in timed sequence off the inner surfaces shortly before the raising of the respective screens. The means for lifting the screens are shown as cams 9 but could just as well be pneumatic or hydraulic cylinders or lift magnets. The cams 9 are actuated by lift drives 10, one for each screen, as shown in FIG. 2.

Figure 2:
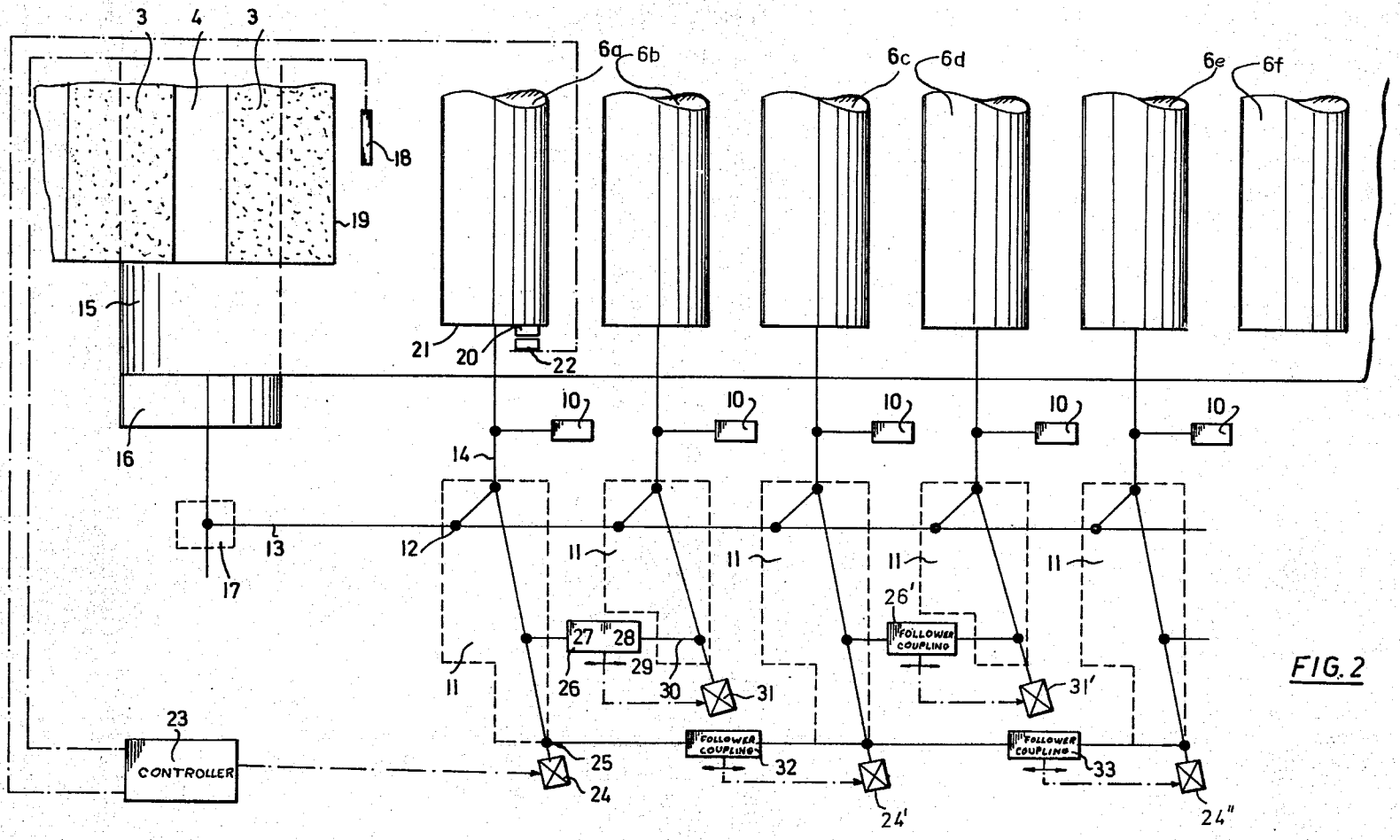
FIG. 2 is a fragmentary top view of the printing units with an associated driving mechanism illustrated diagrammatically.

The screens 6 of the six printing units 5 shown in FIG. 1, designated 6*a* – 6*f* in FIG. 2, are grouped in 2-stage pairs with first-stage screens 6*a*, 6*c*, 6*e* and second-stage screens 6*b*, 6*d*, 6*f*. Each screen is driven from a main shaft 13 through an individual differential gearing 11 having an input 12 connected to that shaft; this gearing 11 has been shown only schematically in FIG. 2 and will be described in greater detail in connection with FIG. 5 below. The peripheral speed of the rotating screens corresponds to the transport speed of the supporting belt 15 whose front guide roller 16 is driven from the same shaft 13 via bevel gearing 17. Upon the passage of a tufted section 3 through a predetermined position, a sensor 18 feels the leading edge 19 of this section. Another sensor 22 detects on a head 21 of the first screen 6*a* the passing of a mark 20 which is provided at the start of the printing pattern of this screen. If the mark 20 is detected by the sensor at the same time the leading edge 19 of the next tufted section 3 is felt by the sensor 18, no readjustment of the angular screen positions takes place. In this case the start of the screen pattern corresponds precisely to the leading edge 19 of the oncoming tufted section as that section reaches the printing stage 6*a*. If, however, there is a difference in time between the two detections, this difference is measured by a counting-pulse circuit and stored in a controller 23. According to the number of pulses counted, a servomotor 24 actuated by the controller 23 drives a second input 25 of the first differential gearing 11, then rotates the first screen 6*a* to such an extent that the edge 19 of the oncoming tufted section coincides precisely again with the start of its printing pattern. This readjustment of the first-stage screen 6*a* of the first pair of printing units takes place while this screen is in its raised position, at a time when the associated second-stage screen 6*b* may be in a lowered position to imprint the second half of a preceding web section. The relative angular positions of the several screens must, however, remain unchanged during the printing of a given web section 3. For this purpose, the corrective movement of screen 6a must also be imparted to the second screen 6*b*, yet this can be done only after the screen 6*b* has been lifted off the web 2 into its raised position.

I therefore insert a follower coupling 26 between the first and second paired screens 6*a*, 6*b* as well as 6*c*, 6*d* and 6*e*, 6*f*. This follower coupling, which will be described in further detail in connection with FIG. 3, comprises two inputs 27, 28 and a differentially actuated output element 29. When the input 27 is actuated by the servomotor 24 as a result of the readjustment of the first screen 6*a* and if, at the same time, a shaft 30 at the other input 28 from the coincidence gearing is held fast, the output element 29 will be moved out of its zero position in one or the other direction. When the second screen 6*b* is subsequently raised upon completion of its previous printing operation, preparatorily to the immediately following printing operation, a servomotor 31 controlled by output element 29 imparts an additional rotation to screen 6*b* and also to the feedback input 28 of coupling 26; since at this time the input 27 thereof is held fast in the position last reached, the differentially actuated output element 29 will be returned to its zero position whereupon the servomotor 31 stops. All the following screen pairs are actuated in the same fashion.

A similar follower coupling 32 is also directly actuated by the first servomotor 24 associated with screen 6*a*. The first two screens 6*a*, 6*b* print respective halves of a recurrent pattern in the same color (e.g. black), being alternately lifted off the web 2 so that the readjustment for the next section to be imprinted can be carried out. The next two screens 6*c*, 6*d* also print respective halves of the pattern, but in a different color (e.g. red).

In certain instances, i.e. with sections 3 whose length is more than twice the center-to-center spacing of the screens, the third screen 6*c* has to go into action earlier than the second screen 6*b*. Accordingly, it is necessary to transmit the corrective movement of the first screen 6a directly to the third screen 6*a* via the follower coupling 32 and not, for instance, via the drive for the second screen 6b and the associated coupling 26. The third screen 6*c* therefore, receives its corrective movement from the upstream servomotor 24, via coupling 32 and another servomotor 24′ which in turn adjusts screen 6*e* via a follower coupling 33 and a servomotor 24″, and so forth.

In the same way that the screen 6*b* receives its corrective movement from the first screen 6*a* through coupling 26 the fourth screen 6*d* is controlled by the third screen 6*c* through a coupling 26′ and a servomotor 31′, and so on. It will thus be seen that each series coupling 32, 33 etc. and each branch coupling 26, 26′ etc. of what may be described as a delayed-transmission chain has input connections to an upstream servomotor (e.g. 24) and a downstream servomotor (e.g. 24′ or 31) and that the latter servomotor is controlled by the output element of the coupling. This transmission chain serves as a mechanical memory for a measure of the angular adjustment of screen 6*a* by controller 23.

In this way all first-stage screens receive their correction commands with the proper timing from controller 23 via the delayed-transmission chain 24, 32, 24′, 33′, 24″ etc. whereas the second-stage screens are adjusted directly from the associated first-stage screens. These corrective movements are, of course, superimposed upon the rotation imparted to all the screens in parallel by the main drive shaft 13 synchronously with the movement of the transport belt 15.

The lift drives 10 are actuated in the case of each screen directly by an output shaft 14 of the corresponding differential gearing 11. Thus, the raising and lowering of the screens takes place in accordance with their corrected angular positions in step with the advance of the web sections 3 to be imprinted.

Figure 3:
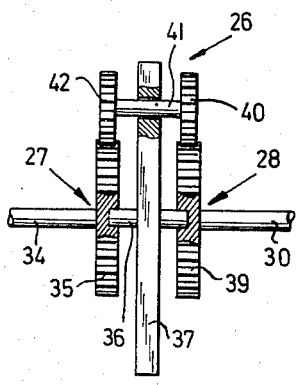
FIG. 3 is a cross-sectional detail view of a follower coupling included in the mechanism of FIG. 2.
Figure 4:
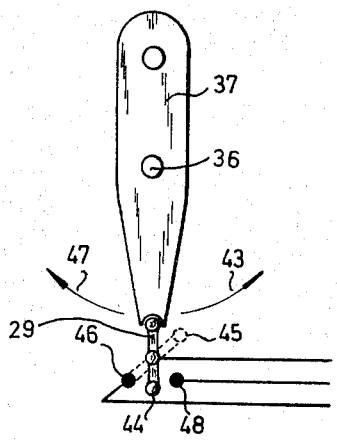
FIG. 4 is a face view of the follower coupling shown in FIG. 3.

In FIGS. 3 and 4 I have shown the follower coupling 26 in further detail. The inputs 27 and 28 of this gearing 26 comprise two aligned shafts 34, 30 and a pair of sun gears 35, 39 rigidly connected therewith. Confronting faces of these gears rotatably support a journal pin 36 for a planet carrier 37. Two planet gears 40, 42, which are rigidly interconnected by a shaft 41, are supported on the carrier 37 and mesh with the sun gears 39 and 35, respectively.

If the planet carrier moves — as shown in FIG. 4— for instance in the counterclockwise direction (arrow 43) because of a rotation of input shaft 34 and a sun gear 35 while the gear 39 and shaft 30 are held fast, a toggle switch representing the output element 29 is moved from its zero position 44 into a tilted position 45 and engages a contact 46. A corresponding control pulse coming from this switch determines the sense of rotation of the servomotor 31 when power is connected thereto.

If the planet carrier 37 is moved, however, in the clockwise direction (arrow 47), then a contact 48 will be engaged by the toggle switch 29 and the pulse which is now emitted, when the servomotor 31 is connected to power, results in an opposite direction of rotation. The rotation of the motor — as has been explained in connection with FIG. 2 — will be started, however, only upon the raising of the corresponding screen and frame assembly.

Figure 5:
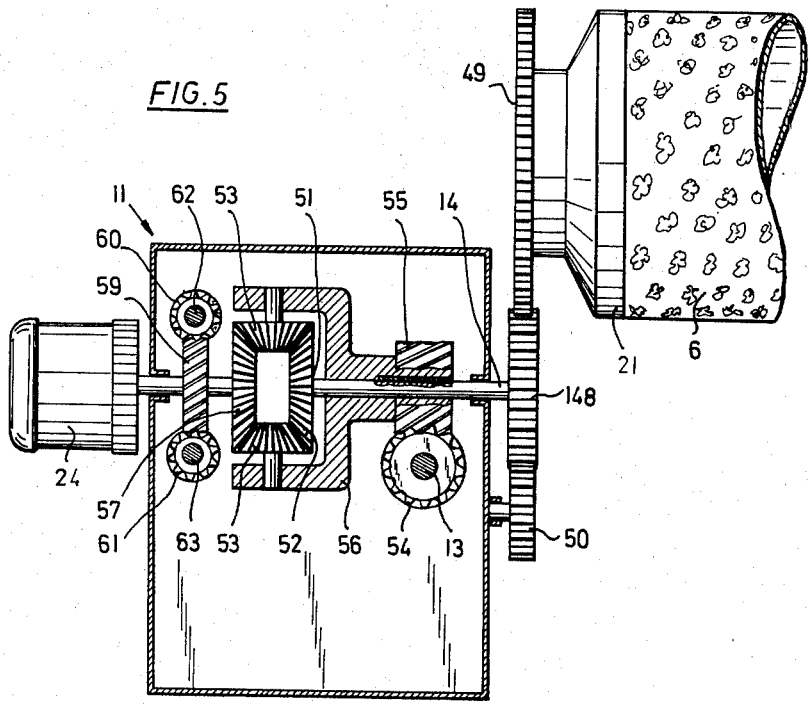
FIG. 5 is a cross-sectional view of a differential gearing associated with one of the printing units.

FIG. 5 shows details of the differential gearing 11 whose output shaft 14 has keyed to it a gear 148 in mesh with a gear 49 fastened to the head 21 of the associate screen 6. The corresponding lift drive 10 (FIG. 20 is coupled with this gear 148 via an intermediate gear 50.

The shaft 14 is connected at its left-hand end 51 with a beveled sun gear 52 which meshes with two planet gears 53 also engaging a sun gear 57. The main shaft 13 drives a worm 54 engaging a worm wheel 55 on a planet carrier or differential housing 56. If the bevel gear 57 is held fast, the rotation of housing 56 is transmitted via the planet gears 53 to the bevel gear 51 and thus also to the shaft 14 and the gear 148. An additional rotation can be imparted to this gear 148 and thus to the screen 6 by the actuation of the servomotor 24 which drives the sun gear 57 and thus also, via the planet gear 53, the shaft 14 and the gear 148. This rotation is also imparted to a worm 59 and thence via two worm wheels 60 and 61 to a pair of shafts 62 and 63 respectively driving the follower couplings 26 and 32 shown inf FIG. 2.

Figure 6:
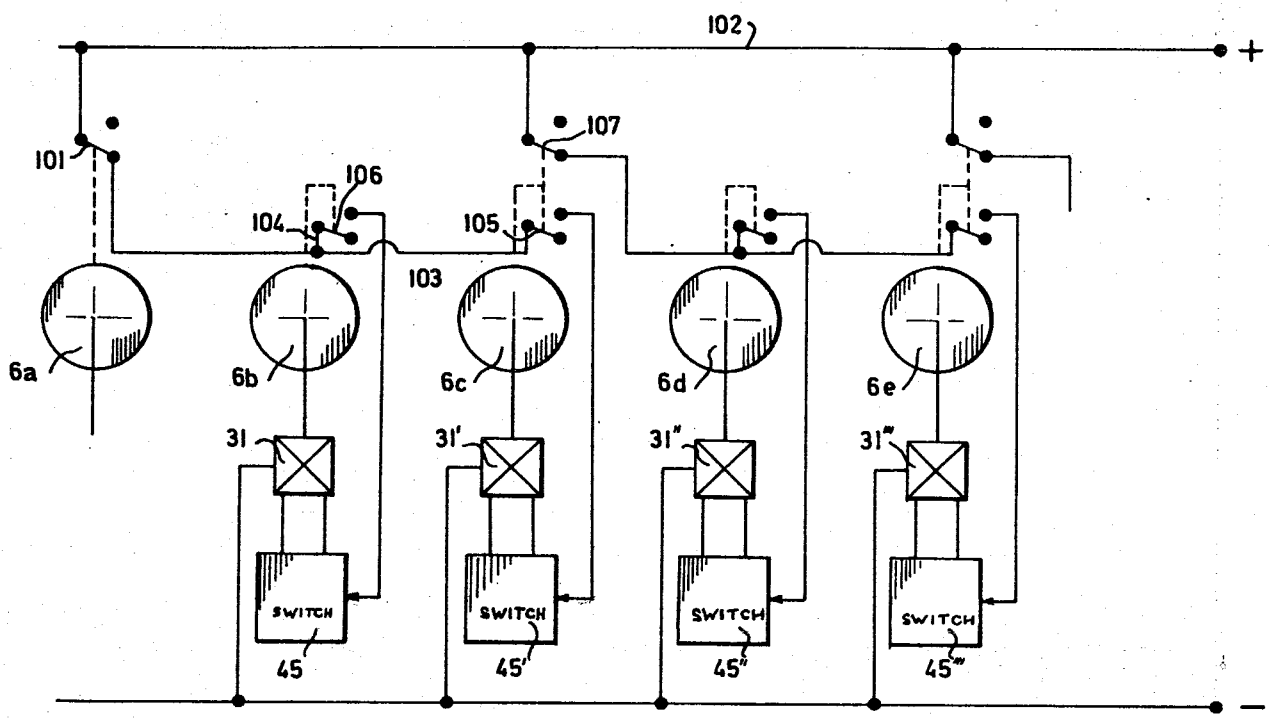
FIG. 6 is a diagram showing part of a control circuit for the angular adjustment of the several printing units.
Figure 7:
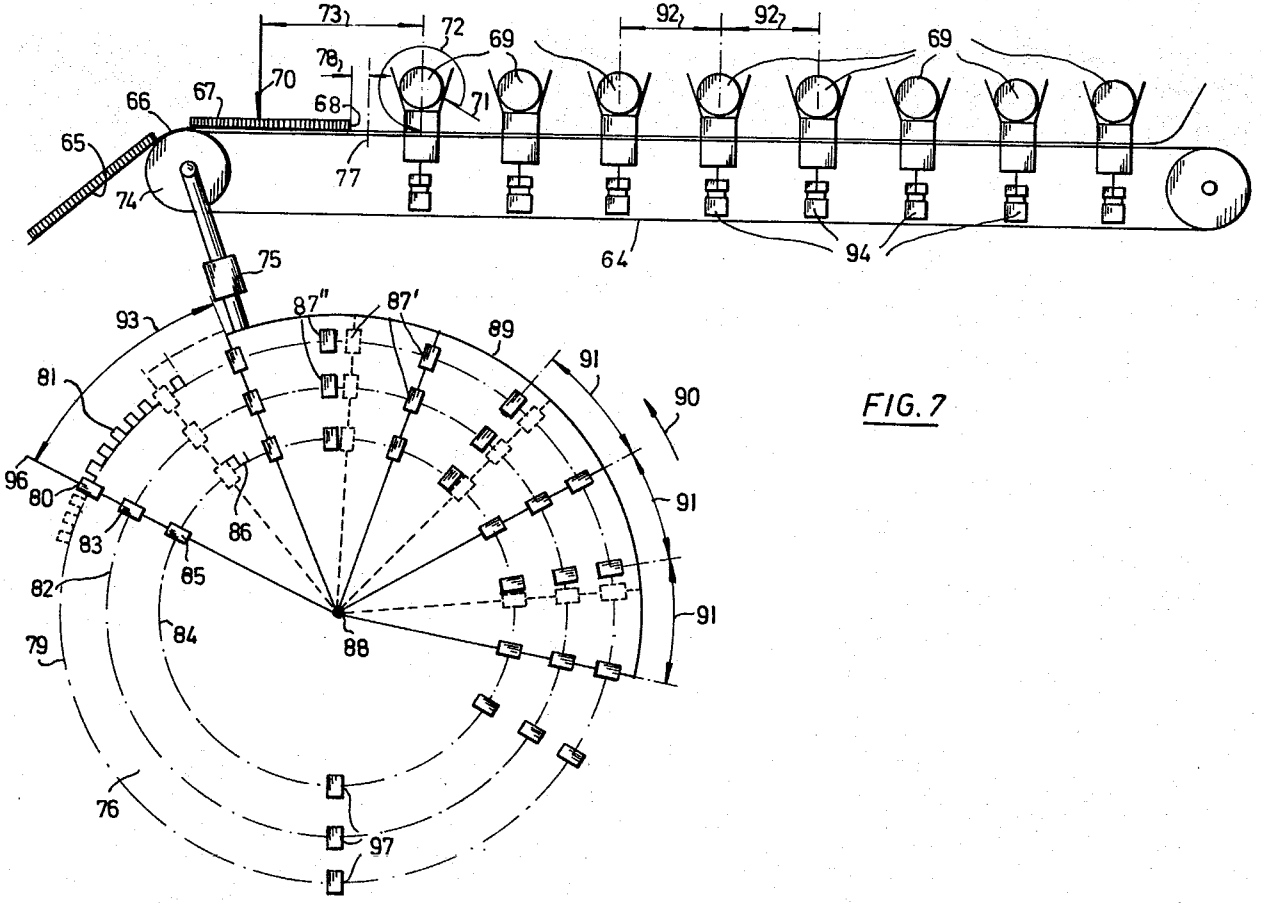
FIG. 7 is a diagrammatic view of another embodiment, with an array of printing units again shown in elevation.

FIG. 6 shows diagrammatically how the individual printing screens 6 are interconnected electrically. Let us assume that the first screen 6*a* and the fourth screen 6*d* are lowered and therefore in printing position, while the other printing screens are in raised position. A switch 101 is so connected with the first screen 6*a* as to be closed when the screen is lowered but open when the screen is raised. This switch connects a bus bar 102 of a power supply to two lines 103 and 104 containing respective switches 105 and 106. The switch 106 is mechanically connected with the screen 6*b* so as to be closed in the raised position thereof, as a result of which a toggle switch 45 in the energizing circuit of this servomotor 31 is connected to power and servomotor 31, with switch 45 closed, can turn in one direction or the other and thus rotate the screen 6*b*.

The switch 105 is associated with the third screen 6*c* and connects power to the corresponding servomotor 31′ via a switch 45′. The screen 3*c* also controls another switch 107 which corresponds to the switch 101 and, in contradistinction to the switch 105, is closed when the screen 6*c* is lowered. Closure of the switch 107 connects power to switches 45″ and 45‴ in the energizing circuits of servomotors 31′ and 31‴ driving the screens.

In FIG. 6 the screen 6*a* is assumed to be lowered and the switch 101 is thus closed. If screens 6*b* and 6*c* are raised and the switches 105 and 106 are closed, these screens can be brought into the proper reference position by means of the corresponding servomotors 31, 31′. Since the switch 107 is open under these circumstances, the servomotors 31″ and 31‴ of the screens 6*d* and 6*e* are then energized. Thus, adjustment of screens 6*d* and 6*e* preparatorily to the imprinting of a given web section 3 can take place only while that section is being imprinted by the screen 6*c*, i.e. while the leading edge of this section approaches the screen 6*e* after passing beneath screen 6*d*. The simultaneously adjustability of screens 6*b* and 6*c*, as well as 6*d* and 6*e*, takes account of the fact that these screens operate more or less concurrently on the front and rear halves, respectively, of a given web section.

FIGS. 7, 8, 9 and 10 show a printing press in which the imprinting of successive web sections is controlled by binary signals which are stored on magnetic plates serving as a memory independent of the screens themselves, i. e. mechanically decoupled therefrom. A textile web 65, again comprising successive sections of tufted cloth 67 of predetermined length, arrives at 66 on a transport belt 64. Here, too, the leading edges 68 of web sections 67 should register with the start of the pattern of a series of printing screens. A sensor 70 detects the edge 68 of the first section 67 whereas a sensor 71 detects the start of the pattern on the first screen 69. When the oncoming web section 67 is in correct position, its edge 68 must pass at the same moment below the sensor 70 as the start of the first screen 69 passes the sensor 71. Moreover, the peripheral distance 72 must be equal to the distance 73 between the axis of the first stencil and the location of the sensor 70 on the printing machine.

The front guide roller 74 of the machine is connected via a gearing 75 with a magnetic disk 76, shown schematically, which therefore is driven at a fixed transmission ratio with reference to the guide roller 74 and thus also to the supporting belt 64. If an oncoming web section 67 is rearwardly offset from its correct starting position in which its leading edge 68 coincides with a dot-dash line 77, the disalignment of this section from the printing pattern of the first screen 69 corresponds to a distance 78.

This means that the starting mark of the first screen passes the sensor 71 first and, after a certain time interval whose length is inversely proportional to the transport speed and directly proportional to the distance 78, the sensor 70 will signal the passing of edge 68. The magnetic disk 76 carries three tracks, the outermost track 79 being inscribed with a binary signal in the form of a square wave as long as the web section 67 lifts the sensor 70. The writing on track 79 is effected by a recording head 80 which is fed from a nonillustrated frequency generator so as to register a pulse train 81 along a track segment. The middle track 82 is inscribed by means of a recording head 83 when the edge 68 of the web section 67 lies downstream of its correct position 77 at the starting point of the pattern so that the sensor 70 responds before the sensor 71. This is not the case in the example illustrated where, at the start, edge 68 of web section 67 lies upstream of position 77 which causes the innermost track 84 to be inscribed by a recording head 85 with a square wave forming a pulse train 86 initiated by the sensor 71 and terminated by the sensor 70. The length of this pulse train 86 and thus the number of binary pulses corresponds precisely to the distance 78 with the selected transmission ratio taken into consideration. The square-wave pulses can be taken from a signal generator which is firmly coupled with the driving gears for the screens; alternatively, the tooth-gap ratio of these driving gears can be converted via an inductive transmitter into a square wave which, however, would permit only a coarse correlation. For each of the printing screens 69 of the machine I provide a respective set of magnetic readings heads 87′, 87″ overlying the three tracks 79, 82, 84 of disk 76. The magnetic reading heads 87′ associated with the odd-numbered magnetic reading heads 87′ associated with the odd-numbered (i.e. first, third, fifth and seventh) printing units are mounted on a frame 89 which is rotatable about the disk center 88 so that they can be displaced in the counterclockwise direction indicated by an arrow 90. At first, the spacings 92 of the printing screens correspond to the separations 91 of the magnetic reading heads 87′, 87″, taking again the transmission ratio into account; thus, a signal on one of the magnetic tracks passes in each case under the reading heads of the corresponding screens when a corresponding point of the transport belt 64 passes below these screens. The reading heads 87′ mounted on the frame 89 are now swung counterclockwise, as indicated by the arrow 90, to an extend corresponding to approximately half the length of any web section 67. Since the initial distance 93 of the recording heads 80, 83 and 85 from the nearest reading heads 87, associated with the first screen, corresponds to the spacing 73 on the printing machine, the beginnings of the pulse trains 81 and 86 after this angular readjustment of the frame 89 pass the reading heads 87 always at the instances when the screens associated with these reading heads have just finished their printing operation. As in the preceding embodiment, the first screen 69 prints the first half of a section 67, for instance in black, and the second screen then prints the second half of the section in the same color. The readjustment of the screens to correct any disalignment is effected also in this instance during the time when the screens are idle and are lifted off the web 65 by hydraulic or pneumatic cylinders 94 which elevate them upon termination of their respective printing operations. If the frame 89 were still in its original position with all sets of reading heads 87′, 87″ equispaced from one another as shown in solid lines, the start of the signal train 81 would reach reading heads 87′ coacting with track 79 just when the leading edge 68 of a given section 67 passes below the nadirs of the corresponding odd-numbered screens. This is the correct time for the readjustment of the even-numbered (i.e. second, fourth, sixth and eighth) screens serving to print the second half of the section 67. For the odd-numbered screens 69, however, this moment would be improperly selected since they must print the first half of the section 67 and are therefore at this time already in contact with the web. The advance of the frame 89 in the direction indicated by the arrow 90 to an extent which corresponds to half the length of the sections 67 lets the reading heads 87′ for the first, third, fifth and seventh screens 69 detect the start of the signal train 81 half a section length earlier, i.e. when the screens have just ended their printing operations and have been lifted. The advanced positions of the reading heads 87′ have been indicated in dashed lines.

It will be observed that, on being thus displaced, the reading heads 87′ generating the commands for the adjustment of the third, fifth etc. printing units lie close to the reading heads 87″ for the second, fourth etc. units so that, as in the arrangement described with reference to FIG. 6, the commands for the even-numbered screens are delayed well beyond the midpoints of the constant time intervals which separate the pick-up of command signals for the odd-numbered screens by reading heads 87′.

Figure 8:
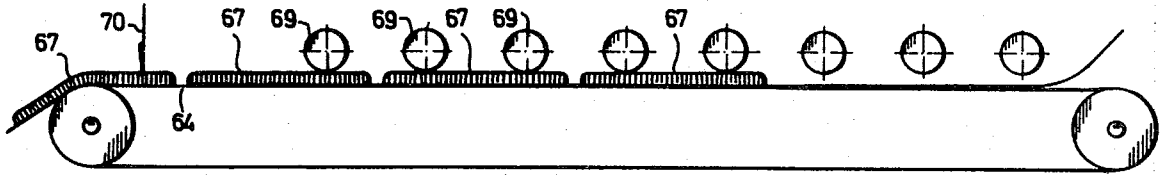
FIG. 8 is an elevational view of the array of FIG. 7 in a different operating position.
Figure 9:
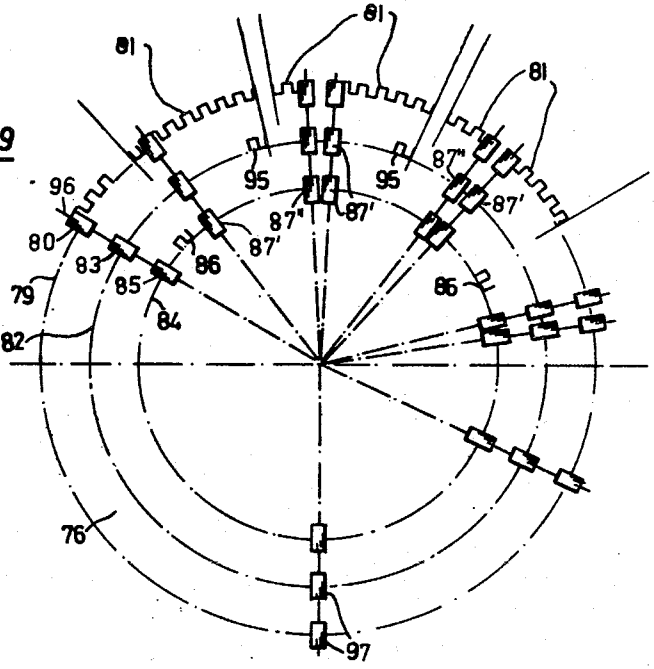
FIG. 9 is a schematic view of a magnetic recording disk also shown in FIG. 7.

FIGS. 8 and 9 show the working positions of the reading heads 87′, 87″ relative to disk 76 having pulse trains 81, 86 and 95 inscribed thereon. The pulse trains 81 on the outermost track 79 denote the length of the web sections 67. The pulse trains 86 on the inner track 84 means that the screens must be rotated backward to an extent determined by the number of stored pulses. The pulse trains 95 on the middle track 82 require the screens to be rotated forward to an extent again determined by the number of pulses stored. This compensating rotation can be carried out in each case at the very moment when the corrective pulse trains 86 or 95 pass the corresponding magnetic reading head 87′ or 87″. Thus, if the start of a pulse train 81 on track 79 passes a reading head, the corresponding screen is lifted off its substrate and immediately thereafter its angular position is changed. This is effected in the manner that the pulses of, for instance, a sequence 86 are fed in amplified form to the respective servomotor 24, 24′ etc. (FIG. 5) to step the associated differential gearing 11. The direction of rotation of the servomotor is such that the screen is turned backward in response to signals 86 from track 84 and forward in the case of signals 95 from track 82. Furthermore, the reading heads of tracks 82 and 84 can be displaced by a small angle with respect to those of track 79 so that the screen-lifting operation is definitely terminated when the correction process commences. The screen drive differs here from that of FIG. 5 by omission of the shafts 62 and 63 as well as the worm-gear assembly 59 – 61.

For a convenient relative adjustment of the reading and recording heads I prefer to mount the recording heads 80, 83 and 85 on a common support 96 which can be swung in either direction to establish the most suitable moment for the lifting of the screens and their angular adjustment. The heads 80, 83 and 85 could also be adjustable independently of one another in their angular position with respect to the magnetic disk 76. Unless these heads 80, 83 and 85 are combined erase-record heads, separate erase heads 97 are to be provided for each of the magnetic tracks 79, 82, 84.

Figure 10:
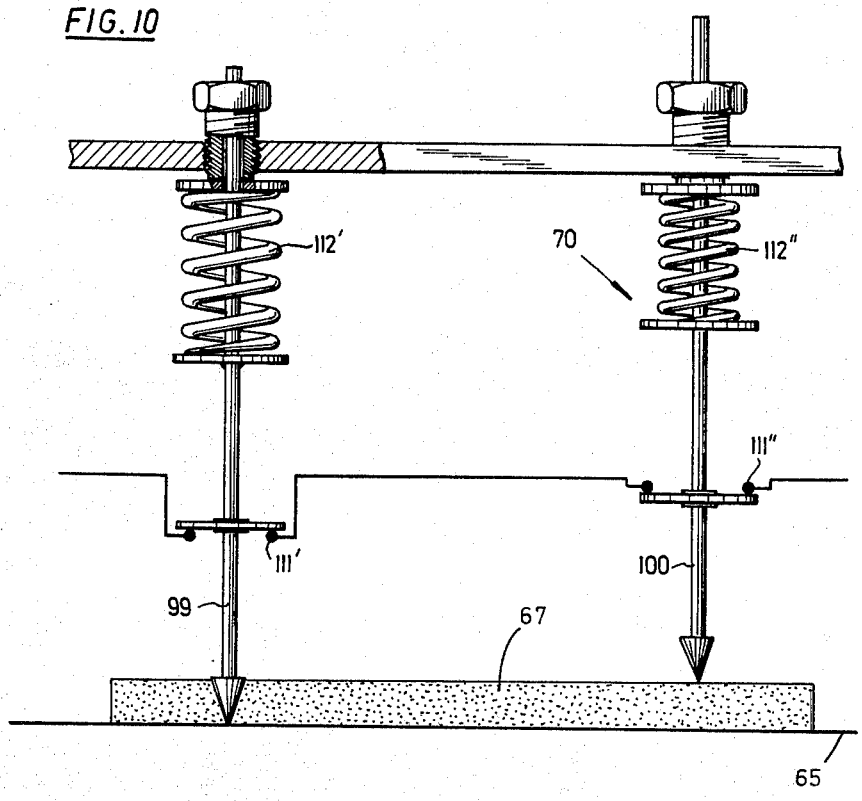
FIG. 10 is a schematic detail view of an edge sensor included in the systems of the preceding Figures.

In FIG. 10 I have shown details of a preferred construction of the sensor 70, comprising two feelers 99, 100 disposed alongside each other. Feeler 99 is loaded by a hard biasing spring 112′ whereas feeler 100 has a soft spring 112″, the feelers carrying respective contacts 111, 111″ connected in series in such a manner that a pulse circuit is completed only when the feeler 100 is raised and the feeler 99 is in its normal position. Such a sensor design is very advantageous for the reason that the soft pile-like tufting fabrics constituting the heavier sections 67 must be distinguished from possible seams in the web 65 which are substantially tougher than the tufts. Upon encountering the leading edge of the section 67, therefore, the strongly biased feeler 99 will sink into the fabric pile and the contact 111′ will be closed. The weakly biased feeler 100, however, will move up so that the contact 111'' is also closed. In the case of seams, on the other hand, both feelers will rise since the seams generally present in such webs will not yield. Thus, contact 111'' is opened and the location of the screens is not misinterpreted as the start of a web section 67. The springs 112', 112'' are replaceable or adjustable in their resiliency by means of nonillustrated screws.

Figure 11:
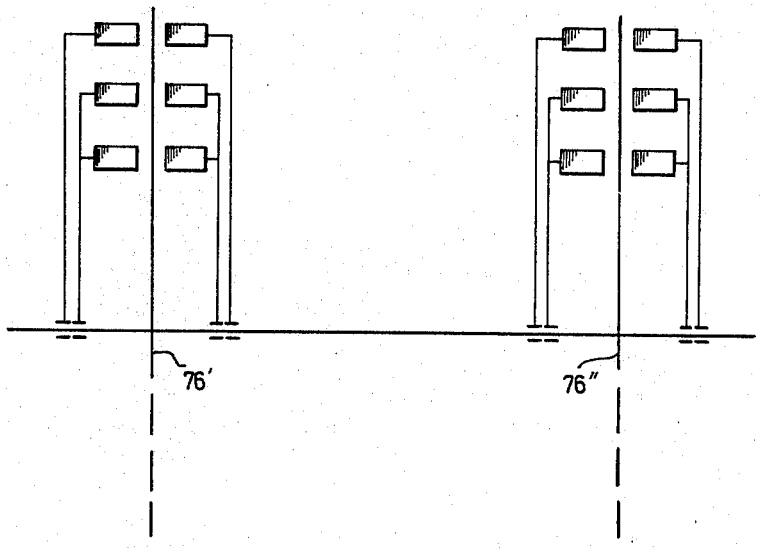
FIG. 11 is a diagrammatic edge view of a pair of recording disks forming part of a modified system of the type shown in FIGS. 7–9.

It is also possible to provide a plurality of magnetic disks 76', 76'' as shown in FIG. 11. In that case one disk can be used for the odd-numbered screens which print the first part of the pattern while the other disk is provided for the even-numbered screens which print the second pattern half. Naturally, the pattern need not be split into only two halves but could also be subdivided into three or four parts.

The starting mark provided on the first screen can, for instance, be an iron rivet in the stencil foil, in which case an inductive detector senses the passage of the rivet.

The magnetic disk or disks 76 could be replaced by other binary storage means known from the computer art, e.g. magnetic tapes. I may also use perforated tapes coacting with punching and mechanical or photoelectrical sensing devices.

Such strip-shaped information carriers can advantageously be conducted through the coacting devices in the form of an endless loop. Naturally, the required ratio of the length and the speed of travel of the loop to the length and the speed of the screens and webs must be taken into consideration.

With binary evaluation of the distances measured by the signal detectors, the resulting digital readings may be converted into analog control signals for the servomotors.

I claim:

1. A process for printing a recurrent composite pattern on equispaced sections of a textile web separated by zones to be left unprinted, said sections being of identical length, comprising the steps of:

a. passing the web to be imprinted underneath a plurality of parallel rotary printing units spaced apart in the direction of web motion while rotating said printing units in unison about respective axes at a speed commensurate with the web speed, each printing unit including a cylindrically curved screen centered on the respective axis with an arc length equal to the length of a section for the printing of a respective pattern component;

b. detecting the arrival of a leading edge of any of said sections at a fixed point upstream of the first printing unit;

c. detecting the passage of a predetermined point on the periphery of said first printing unit through a certain angular position;

d. lifting each unit off the web after the printing of the respective pattern component; and e. angularly adjusting all said printing units in their lifted positions, in accordance with the relative time position of the events detected in steps (b) and (c), sequentially and with intervening delays corresponding to the travel time of said section from one printing unit to the next.

2. A process as defined in claim 1, comprising the further step of (f) storing a measure of the angular adjustment according to step (d) in a memory decoupled from said first printing unit preparatorily to adjustment of each subsequent printing unit, thereby enabling readjustment of said first printing unit upon the approach of each new section.

3. A process for printing a recurrent composite pattern on equispaced sections of a textile web separated by zones to be left unprinted, said sections being of identical length, comprising the steps of:

a. passing the web to be imprinted underneath a plurality of parallel rotary printing units spaced apart in the direction of web motion while rotating said printing units in unison about respective axes at a speed commensurate with the web speed, each printing unit including a cylindrically curved screen centered on the respective axis with an arc length equal to the length of a section for the printing of a respective pattern component;

b. detecting the arrival of a leading edge of any of said sections at a fixed point upstream of the first printing unit;

c. detecting the passage of a predetermined point on the periphery of said first printing unit through a certain angular position;

d. angularly adjusting all said printing units, in accordance with the relative time position of the events detected in steps (b) and (c), sequentially and with intervening delays corresponding to the travel time of said section from one printing unit to the next; and e. storing a measure of the angular adjustment according to step (d) in a memory decoupled from said first printing unit preparatorily to adjustment of each subsequent printing unit, thereby enabling readjustment of said first printing unit upon the approach of each new section.

4. A process as defined in claim 3 wherein said sections are tufted areas and are separated from one another by untufted zones, the detection of a leading edge in step (b) involving a mechanical sensing of the tufts of an oncoming section.

5. A process as defined in claim 4 wherein the tufts are sensed with a first and a second pointed implement disposed alongside each other and loaded with a first and a second pressure, respectively, said first pressure exceeding said second pressure, elevation of the second but not the first implement above the web surface indicating the arrival of a leading edge at said fixed point.

6. A process for printing a recurrent composite pattern on equispaced tufted areas of a textile web separated by untufted zones to be left unprinted, said areas being of identical length, comprising the steps of:

a. passing the web to be imprinted underneath a plurality of parallel rotary printing units spaced apart in the direction of web motion while rotating said printing units in unison about respective axes at a speed commensurate with the web speed, each printing unit including a cylindrically curved screen centered on the respective axis with an arc length equal to the length of a tufted area for the printing of a respective pattern component;

b. detecting the arrival of a leading edge of any tufted area at a fixed point, upstream of the first printing unit, by sensing the tufts of any of said areas at said fixed point with a first and a second pointed implement disposed alongside each other and loaded with a first and a second pressure, respectively, said first pressure exceeding said second pressure whereby the arrival of said leading edge is indicated by an elevation of the second but not the first implement above the web surface;

c. detecting the passage of a predetermined point on the periphery of said first printing unit through a certain angular position; and d. angularly adjusting all said printing units, in accordance with the relative time position of the events detected in steps (b) and (c).

7. A process as defined in claim 6 wherein the angular adjustment of said printing units is carried out sequentially with intervening delays corresponding to the travel time of said tufted area from one printing unit to the next.

8. A process as defined in claim 7 wherein each unit is lifted off the web after the printing of the respective pattern component, the angular adjustment of any printing unit being carried out in an elevated position thereof.

* * * * *